United States Patent [19]

Strecker

[11] Patent Number: 4,798,636

[45] Date of Patent: Jan. 17, 1989

[54] COMPOSITE SOLID PROPELLANT

[75] Inventor: Ruediger Strecker, Waldkraiburg, Fed. Rep. of Germany

[73] Assignee: Bayern-Chemie Gesellschaft fuer flung-chemische Antriebe mbH, Aschau, Fed. Rep. of Germany

[21] Appl. No.: 152,311

[22] Filed: Feb. 3, 1988

[30] Foreign Application Priority Data

Feb. 12, 1987 [DE] Fed. Rep. of Germany ..... 3704305

[51] Int. Cl.[4] ..... C21D 1/568

[52] U.S. Cl. ..... 149/19.9; 149/22; 149/2; 149/21; 102/290

[58] Field of Search ..... 149/2, 22, 21, 19.9; 102/289, 290, 291

[56] References Cited

U.S. PATENT DOCUMENTS

| | | | |
|---|---|---|---|
| 3,921,394 | 11/1975 | Tannenbaum | 149/22 |
| 3,986,909 | 10/1976 | Macri | 149/19.9 |
| 3,986,910 | 10/1976 | McCulloch et al. | 149/19.9 |
| 4,381,270 | 4/1983 | Bjorn et al. | 149/14 |
| 4,601,862 | 7/1986 | Byrd et al. | 149/19.9 |
| 4,658,578 | 4/1987 | Shaw | 149/19.9 X |

FOREIGN PATENT DOCUMENTS

| | | |
|---|---|---|
| 2427480 | 4/1979 | Fed. Rep. of Germany . |
| 862289 | 3/1961 | United Kingdom . |
| 964437 | 7/1964 | United Kingdom . |

*Primary Examiner*—Peter A. Nelson

*Attorney, Agent, or Firm*—W. G. Fasse; D. H. Kane, Jr.

[57] ABSTRACT

In order to achieve a stable burn characteristic, improved mechanical properties and reduced smoke development during burn, a composite solid propellant includes nitrides, borides, and carbonitrides of the metals zirconium, titanium, tungsten, hafnium, tantalum, or niobium as a burn moderator.

7 Claims, 3 Drawing Sheets

BURNER UNIT B (MIXTURE 5)

BURNER UNIT C (MIXTURE 5)

COMPOSITE SOLID PROPELLANT

FIELD OF THE INVENTION

The invention relates to a composite solid propellant, for example a rocket propellant.

DESCRIPTION OF THE PRIOR ART

Composite solid propellants of this type generally include an oxidizer and a hardenable binder made of telomeric polybutadiene or a polymer of butadiene and acrylonitrile with functional groups distributed statistically along the polymer chains or at the terminal positions. Such a composite solid propellant further includes a polyether or polyester and a burn moderator in the form of carbon and a metallic compound having a melting temperature greater than 2400° C. The solid propellant may further include other additive components such as softeners or burn catalysts.

In order to increase the output power of such composite propellants, light metals such as aluminum or magnesium may be added to the composite mixture. During the burn, these light metals form oxides generating solid particles which cause a primary smoke. However, it is often advantageous to reduce the development of smoke to a minimum, especially for instance in solid propellant rockets used for military purposes.

Through the inclusion of telomeric polybutadienes, such as hydroxyl terminated polybutadiene (HTPB), polymers of butadiene and acrylonitrile with terminal functional groups or functional groups statistically distributed along the polymer chains, polyethers and polyesters, the solid material content of the propellants was increased. This was achieved while maintaining the output power and maintaining or even improving the mechanical characteristics of the propellant composite, whereby it became possible to avoid the use of light metals which develop primary smoke during the burn. However, it was discovered that when the light metals were omitted, an unstable burn characteristic arose.

This detrimental effect is caused because the solid particles tend to damp the gas oscillations which arise in the combustion chamber of a rocket motor which is closed except for the nozzle opening. If solid particles are not present to damp these oscillations, the oscillations detrimentally affect the burn process and in an extreme case can even lead to the destruction of the rocket motor and hence to the loss of a spacecraft or aircraft.

In order to prevent these burn instabilities, it has been suggested to add to the propellant mixture a small amount of a burn moderator made of a high melting temperature metallic compound and carbon particles. For example, in the British Patent Publication (GB-PS) No. 862,289, zinc oxide and magnesium oxide are used as a metallic compound for damping the burn instabilities. According to the British Patent Publication (GB-PS) No. 964,437 aluminum oxide is used as the metallic compound. As disclosed in the German Patent Publication (DE-AS) No. 2,427,480 a metal carbide or oxides of thorium, tungsten, silicon, molybdenum, aluminum, hafnium, vanadium, and zirconium are used as the metallic compound damping agents. However, the addition of zinc or magnesium oxides did not achieve a satisfactory damping. The use of aluminum oxide also failed to achieve the required damping effect and, in one case, it was determined that it had led to the destruction of a rocket motor, as shown further below. The use of metal carbides as described in the German Patent Publication (DE-AS) No. 2,427,480 achieves a noticeable damping of the burn instabilities, but the use of these metal carbides is seriously detrimental to the mechanical characteristics of prior art solid propellants. The use of carbon in the form of hollow spheres or pellets as described in the German Patent Publication (DE-AS) No. 2,427,480 also leads to problems with respect to the mechanical characteristics of the propellant and also with respect to the manufacturing workability of the propellant because the hollow spheres or pellets are easily crushed and thereby lead to an increase in the viscosity of the mixture.

OBJECTS OF THE INVENTION

In view of the foregoing it is the aim of the invention to achieve the following objects singly or in combination:

to provide an improved composite solid propellant, for example, for burning in a rocket motor;

to achieve a stable burn characteristic over a large range of burn rates of such a composite solid propellant by means of effectively damping gas oscillations which would otherwise occur during the burning;

to achieve an improved output power when burning such a composite solid propellant of the invention as compared to the prior art;

to achieve as little smoke development as possible during the burning of such a solid propellant; and to achieve improved mechanical characteristics of the propellant composite including good manufacturing workability of the composite mixture.

SUMMARY OF THE INVENTION

The above objects have been achieved according to the invention in a composite solid propellant, including an oxidizer, a hardenable binder made of telomeric polybutadienes, polymers of butadiene and acrylonitrile with functional groups located at the terminal positions or statistically distributed along the polymer chains, polyethers or polyesters, a burn moderator made of a metallic compound having a melting temperature above 2400° C., and soot as well as other component additions, such as softeners or burn catalysts. Specifically, the burn moderating metallic compound includes a nitride, a carbonitride or boride of the metals zirconium, titanium, tungsten, hafnium, tantalum, and niobium, having a melting temperature greater than 2400° C.

A melting temperature exceeding 2400° C. assures that the metallic compound remains in solid form even at the high temperatures of the combustion gases of the burning propellant, whereby the metallic compound is capable of damping the gas oscillations which would otherwise occur in the rocket motor during burning of the propellant. The particle size of the metallic compound should be in the range of 1 and 20 microns and preferably between 3 and 12 microns. The particle size is primarily controlled or affected by the rocket motor geometry. In order to achieve a noticeable damping effect at least 0.1 weight percent of the metallic compound must be included in the propellant mixture. In general, the content of the metallic compound in the propellant is between 0.5 and 2.0 weight percent.

Furthermore, in the solid propellant according to the invention, the content of carbon, preferably in the form of soot, is between 0.1 and 5.0 weight percent, whereby a carbon content of 2 weight percent or less is usually sufficient to achieve the desired results.

The solid propellant according to the invention preferably comprises 60 to 90 weight percent solid oxidizers, 8 to 30 weight percent binder, 0.1 to 5.0 weight percent burn moderators in the form of metallic compounds and soot, and 0 to 4 weight percent burn catalysts.

The present solid oxidizer preferably comprises an ammonium salt of nitric acid and/or perchloric acid. Other oxidizers which may be used according to the invention are nitramines, such as hexogen (RDX) or octogen (HMX), which may be used alone or in a mixture with monosalts of perchloric or nitric acids.

The binder used in the propellant according to the invention may be a telomeric polymer such as polybutadiene, copolymers of butadiene and acrylonitrile, polyester, polyether, and caprolactones with functional groups inserted. The functional groups may either be located at the terminal positions or statistically distributed along the polymer chains. Preferred polymers are carboxyl terminated polyesters, and polybutadienes, hydroxyl terminated polybutadienes, polyethers, caprolactones, or copolymers of butadiene and acrylic acid or terpolymers of butadiene, acrylic acid and acrylonitrile.

If the functional group is a carboxyl group, the corresponding polymers may be cured or hardened with aziridenes, epoxides, or amines. The hardening of polymers with hydroxyl groups is preferably carried out with di- or poly-isocyanates and preferably with aliphatic di- or poly-isocyanates in order to advantageously reduce the development of smoke during burning of the propellant. Depending on the reactivity of the specific isocyanate used, further curing accelerators or curing inhibitors may be added. The binder system may further comprise additional components which do not participate in the curing process. For example, in order to increase the pourability of the propellant, softening agents may be added, such as hydrocarbons, esters, or nitroesters and nitroformales/acetales, which are energetically preferred due to the nitro groups. Further processing aids such as viscosity reducing agents, for example lecithin, or such as antioxidant agents, and others may also be added.

The burn catalysts according to the invention may comprise, for example, iron oxide, copper chromite, copper oxide, mangenese oxide, n-butylferrocene, ferrocene, catocene, or the like. Depending upon the desired burn rate of the propellant, the burn catalyst is added in a proportion between 0 and 4 weight percent.

The soot and the metal-nitrides, carbonitrides, borides of the propellant according to the invention act as burn moderators. The density and the melting point of several burn moderators/metallic compounds used according to the invention, are given in Table 1 below.

TABLE 1

| Compound | Density ($g/cm^3$) | Melting Temperature (°C.) |
|---|---|---|
| $HfB_2$ | 10.5 | 3250 |
| $NbB_2$ | 6.97 | 3000 |
| $TaB_2$ | 12.0 | 3037 |
| $TiB_2$ | 4.5 | 2790 |
| WB | 15.3 | 2800 |
| $ZrB_2$ | 6.09 | 3200 |
| HfN | 11.7 | 3000 |
| TaN | 13.8 | 3087 |
| ZrN | 7.09 | 2980 |
| TiN | 5.43 | 2947 |
| Ti (C,N) | 5.20 | 3097 |

As shown in Table 1, the metallic compounds have a high melting temperature of 2800° C. to 3250° C., and a high density of 4.5 $g/cm^3$to 15.3 $g/cm^3$. A high density is in general desirable for achieving a good damping characteristic. Furthermore, a high density of the metallic compound reduces the required volume fraction of the metallic compound in the propellant and thereby improves the workability of the propellant mixture.

BRIEF DESCRIPTION OF THE DRAWINGS

In order that the invention may be clearly understood, it will now be described, by way of example, with reference to the accompanying drawings, wherein.

Figure 1:
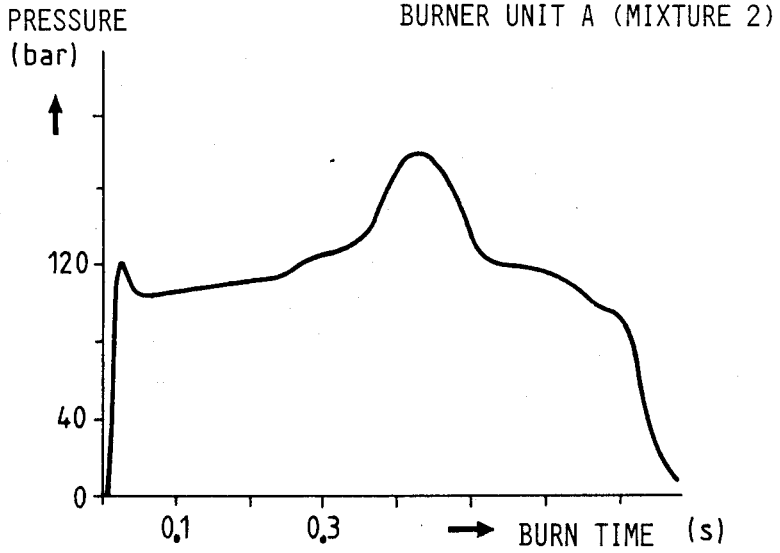
FIG. 1 is a combustion diagram showing developed pressure vs. burn time of a comparison propellant mixture 2 in Table 2, burning in a tube burner unit A.

DETAILED DESCRIPTION OF PREFERRED EXAMPLE EMBODIMENTS AND OF THE BEST MODE OF THE INVENTION

Eight different propellant mixtures were prepared with the compositions given in the following Table 2. The propellant mixtures 1 to 3 are comparison mixtures representing conventional composite propellants while the propellant mixtures 4 to 8 are composites of a composite solid propellant according to the invention.

TABLE 2

COMPOSITION AND BURN CHARACTERISTICS OF COMPOSITE SOLID PROPELLANTS

| Propellant Mixture No. | Oxidizer wt. % | Catalyst wt. % | Soot wt. % | $Al_2O_3$ wt. % | ZrN wt. % | $ZrB_2$ wt. % | TiN wt. % | Ti(C,N) wt. % | rmm/s 20° C. 70 bar | Burn Stability in Burner Unit A | B | C |
|---|---|---|---|---|---|---|---|---|---|---|---|---|
| 1 | 86.5 | — | 0.5 | — | — | — | — | — | 8.0 | stable | instable | — |
| 2 | 86.5 | 0.4 | 0.5 | — | — | — | — | — | 11.4 | instable | — | instable |
| 3 | 86.0 | 0.5 | 0.5 | 0.5 | — | — | — | — | 12.0 | instable | — | — |
| 4 | 86.5 | — | 0.5 | — | 0.5 | — | — | — | 8.0 | stable | stable | — |
| 5 | 85.5 | 0.3 | 0.5 | — | 1.0 | — | — | — | 11.6 | stable | stable | stable |
| 6 | 85.5 | 0.4 | 0.5 | — | — | 1.0 | — | — | 15.0 | stable | — | — |

TABLE 2-continued

| COMPOSITION AND BURN CHARACTERISTICS OF COMPOSITE SOLID PROPELLANTS | | | | | | | | | | | | |
|---|---|---|---|---|---|---|---|---|---|---|---|---|
| Propellant Mixture No. | Oxidizer wt. % | Catalyst wt. % | Soot wt. % | $Al_2O_3$ wt. % | ZrN wt. % | $ZrB_2$ wt. % | TiN wt. % | Ti(C,N) wt. % | rmm/s 20° C. 70 bar | Burn Stability in Burner Unit A | B | C |
| 7 | 85.5 | 0.4 | 0.5 | — | — | — | 1.0 | — | 15.0 | stable | — | — |
| 8 | 85.5 | 0.4 | 0.5 | — | — | — | — | 1.0 | 15.6 | stable | — | — |

In all of the mixture examples 1 to 8, ammonium perchlorate was used as the oxidizer and iron oxide was used as the burn catalyzer. Similarly, the binder, the curing catalyst, the softening agent, and other additive components had the same composition and were added in equal quantities to the propellant mixtures of all the examples 1 to 8. Examples 1 to 3 are conventional propellants. Examples 4 to 8 are propellants of the invention.

The burn rate "r" is given in mm per second for a propellant temperature of 20° C. burning in a combustion chamber at a pressure of 70 bar. The burn characteristic and burn stability were tested in three different rocket motors or burner units. The burner unit A is a tube burner unit with a combustion chamber inner diameter of 5.08 cm (2 inches). Burner unit B is an internal star burner with a combustion chamber inner diameter of 6.99 cm (2.75 inches). Burner unit C is a star tube burner with a combustion chamber inner diameter of 13.97 cm (5.5 inches).

As shown in Table 2, none of the conventional comparison example propellant mixtures 1 to 3 achieved a stable burn characteristic in any of the three burner units A, B, and C. In comparison, the propellant mixture according to the invention, as given by the mixtures 4 to 8, achieved a stable burn characteristic in all cases in the three burner units A, B, and C.

Figure 2:
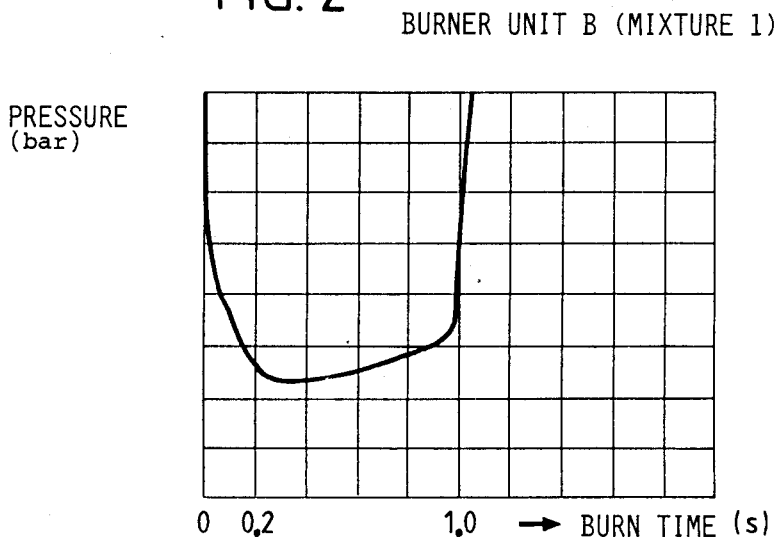
FIG. 2 is a combustion diagram for a comparison propellant mixture 1 of Table 2, burning in an internal star burner unit B.
Figure 3:
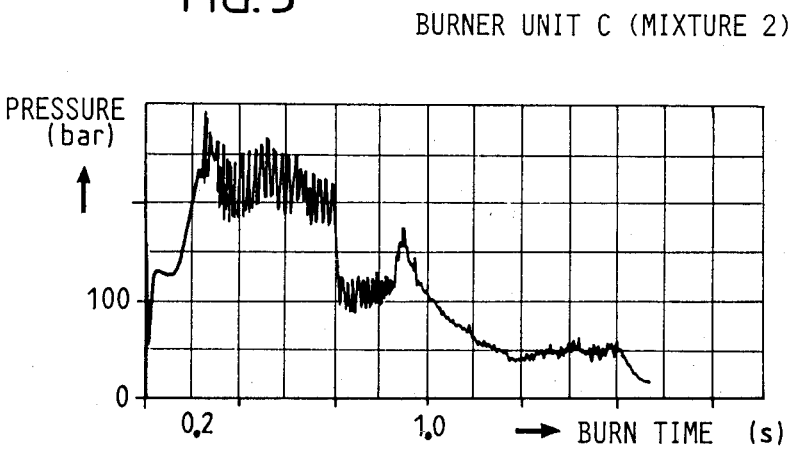
FIG. 3 is a combustion diagram for a comparison propellant mixture 2 in Table 2, burning in a star tube burning unit C.
Figure 4:
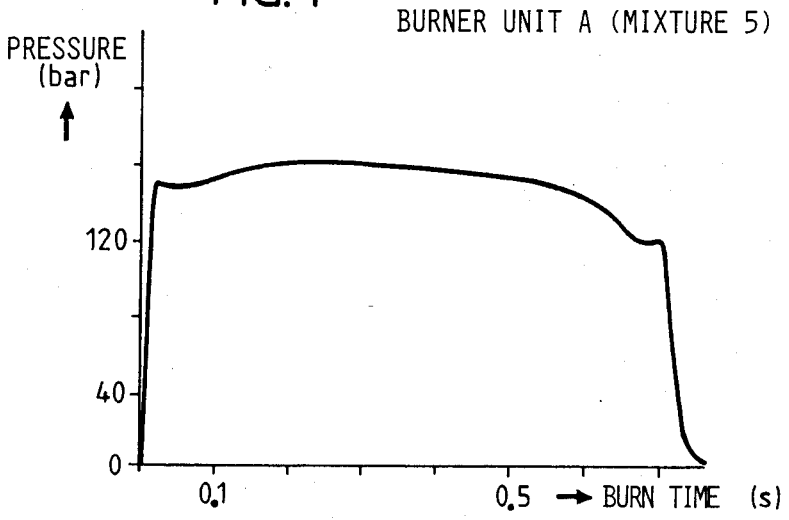
FIG. 4 is a combustion diagram for a solid propellant mixture 5 in Table 2, according to the invention, burning in a tube burner unit A, compared to FIG. 1, the more constant pressure throughout the burn time is quite apparent.
Figure 5:
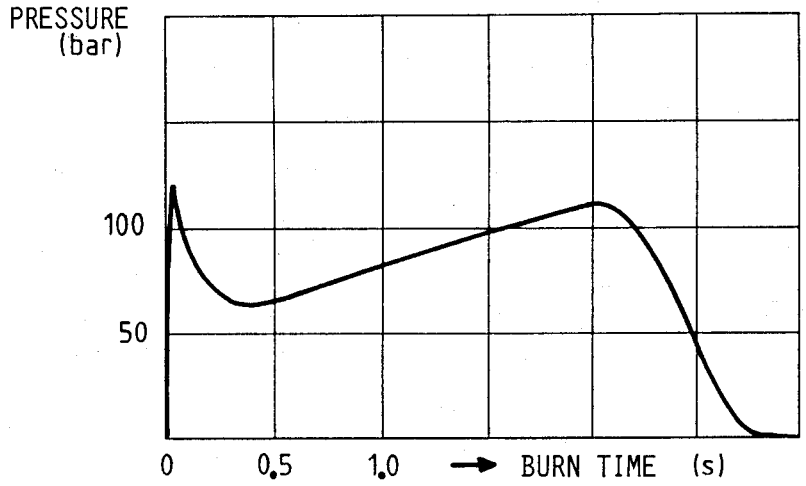
FIG. 5 is a combustion diagram for the propellant mixture 5 of the Table 2, according to the invention burning in an internal star burner unit B.
Figure 6:
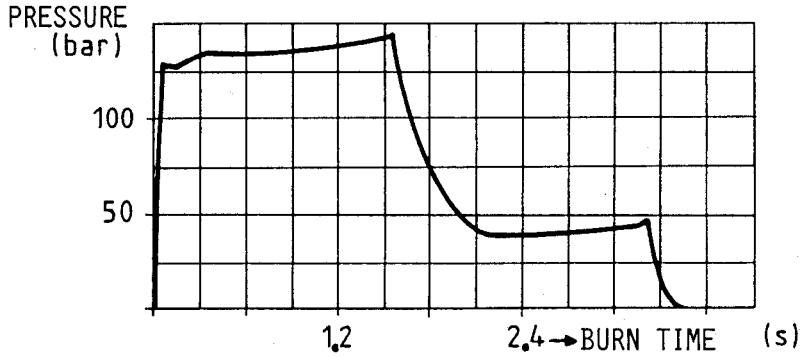
FIG. 6 is a combustion diagram for the propellant mixture 5 of Table 2, according to the invention, burning in a star tube burner unit C.

As shown in FIGS. 1, 2, and 3, considerable pressure fluctuations occur during the burn of conventional propellants represented by the example mixtures 2, 1, and 2 respectively. The pressure increase shown in FIG. 2 even led to the explosion of the rocket engine in which the propellant mixture number 1 was being burned. In contrast, FIGS. 4, 5, and 6 relating to a propellant mixture according to the invention as represented by the example mixture 5, for instance, achieves an approximately constant pressure throughout the burning in FIG. 4 and avoids pronounced pressure peaks as shown in FIGS. 5 and 6, whereby, a stable burning is never achieved by the propellant mixture according to the invention. Burner unit A was used for FIG. 4, burner unit B was used for FIG. 5, and burner unit C was used for FIG. 6.

Furthermore, the propellant according to the invention surprisingly exhibits a considerable improvement of mechanical characteristics over a large temperature range and especially at low temperatures relative to a propellant which comprises carbides as the burn moderating agent.

In order to demonstrate the improved mechanical characteristics, a comparison example propellant mixture 9 was prepared with a composition similar to that of the mixture 5 according to the invention, except that 1.0 weight percent of zirconium carbide instead of 1.0 weight percent of zirconium nitride was included as a burn moderator. The mechanical properties of the propellant mixture 5 including zirconium nitride as a burn moderator according to the invention and of the comparison propellant mixture 9 including zirconium carbide as a burn moderator are shown in the following Table 3.

TABLE 3

| COMPARISON OF MECHANICAL PROPERTIES OF PROPELLANT WITH DIFFERENT MODERATOR COMPONENTS | | | | | | | | | | |
|---|---|---|---|---|---|---|---|---|---|---|
| | T | −54° C. | | | +20° C. | | | +65° C. | | |
| Propellant Mixture No. | Burn Moderator (%) | $E_o$ (N/mm²) | $(\sigma/\epsilon)_R$ (N/mm²/%) | $(\sigma/\epsilon)_B$ (N/mm²/%) | $E_o$ (N/mm²) | $(\sigma/\epsilon)_R$ (N/mm²/%) | $(\sigma/\epsilon)_B$ (N/mm²/%) | $E_o$ (N/mm²) | $(\sigma/\epsilon)_R$ (N/mm²/%) | $(\sigma/\epsilon)_B$ (N/mm²/%) |
| 5 | ZrN 1.0 | 20.0 | 2.13/52 | 2.43/33 | 2.79 | 0.75/50 | 0.79/46 | 1.75 | 0.48/52 | 0.51/45 |
| 9 | ZrC 1.0 | 35.9 | 2.41/33 | 2.71/21 | 2.86 | 0.58/40 | 0.64/35 | 1.71 | 0.40/43 | 0.40/30 |

In the foregoing Table 3 the following abbreviations are used.

$E_o$=modulus of elasticity $\sigma$=tensile strength $\epsilon$=strain $(\sigma/\epsilon)_R$=rupture tensile strength $(\sigma/\epsilon)_B$=ultimate tensile strength As shown in Table 3 the propellant mixture 5 according to the invention has a modulus of elasticity of 1.75, a tensile strength of 0.51, a rupture strength of 0.48/52 and a maximum tensile strength of 0.51/45 at +65° C. The propellant mixture 5 according to the invention has a modulus of elasticity of 20.0 at −54° C. In other words, it remains relatively elastic even at low temperatures. In comparison, the propellant mixture 9 has approximately the same strength characteristics at +65° C., but at −54° C. its modulus of elasticity increases to 35.9. In other words, at low temperatures, the use of prior known burn moderators makes the propellant mixture considerably more brittle, and therefore subject to crumbling more than the propellant mixture according to the invention.

Although the invention has been described with reference to specific example embodiments, it will be appreciated, that it is intended to cover all modifications and equivalents within the scope of the appended claims.

What I claim is:

1. A composite solid propellant, comprising: an oxidizer, a hardenable binder selected from the group consisting of telomeric polybutadiene, polymers of butadiene and acrylonitrile having functional groups located at polymer chain terminal positions or statistically distributed along the polymer chains, polyethers, and polyesters; a burn moderator comprising a metallic compound having a melting temperature not less than 2400° C. and including soot; and additives including softeners and burn catalysts; said metallic compound of said burn moderator being selected from the group consisting of a nitride, a carbonitride, and a boride of zirconium, titanium, tungsten, hafnium, tantalum, and niobium.

2. The solid propellant of claim 1, wherein said metallic compound of said burn moderator comprises zirconium nitride.

3. The solid propellant of claim 1, wherein said metallic compound of said burn moderator is present as a moderator proportion of between 0.1 and 5.0 weight percent of the solid propellant weight.

4. The solid propellant of claim 3, wherein said moderator proportion comprises between 0.5 and 2.0 weight percent of the solid propellant weight.

5. The solid propellant of claim 1, wherein said metallic compound of said burn moderator comprises solid particles having a particle size between 1 and 20/μm.

6. The solid propellant of claim 5, wherein said solid particles have a particle size between 3 and 12/μm.

7. The solid propellant of claim 1, comprising between 60 and 90 weight percent of said oxidizer, between 8 and 30 weight percent of said binder, between 0.1 and 5.0 weight percent of said burn moderator, and between 0.0 and 4.0 weight percent of said burn catalysts.

* * * * *

UNITED STATES PATENT AND TRADEMARK OFFICE

CERTIFICATE OF CORRECTION

PATENT NO. : 4,798,636

DATED : January 17, 1989

INVENTOR(S) : Ruediger Strecker

It is certified that error appears in the above-identified patent and that said Letters Patent is hereby corrected as shown below:

Title page:

Please correct [73] Assignee to read:

-- BAYERN-CHEMIE Gesellschaft fuer
flugchemische Antriebe mbH,
Aschau, Fed. Rep. of Germany--

Signed and Sealed this

Sixteenth Day of May, 1989

*Attest:*

*Attesting Officer*

DONALD J. QUIGG

*Commissioner of Patents and Trademarks*